US006595792B1

(12) United States Patent
Rudolph et al.

(10) Patent No.: US 6,595,792 B1
(45) Date of Patent: Jul. 22, 2003

(54) TAMPER RESISTANT PLUG FOR CHANGING A FUNCTION OF AN ELECTRONIC DEVICE

(75) Inventors: Daniel C. Rudolph, Corvallis, OR (US); Chadwick W. Stryker, Albany, OR (US); Craig E. McDaniel, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 11 days.

(21) Appl. No.: 09/699,855

(22) Filed: Oct. 30, 2000

(51) Int. Cl.[7] ..... H01R 4/50

(52) U.S. Cl. ..... 439/345; 439/147; 439/148; 439/488; 439/490

(58) Field of Search ..... 439/345, 346, 439/350, 352, 358, 148, 149, 188, 744, 746, 488, 359, 490, 135; 411/508, 509, 913, 21, 28, 3, 5; 340/652

(56) References Cited

U.S. PATENT DOCUMENTS

| | | | | | |
|---|---|---|---|---|---|
| 3,002,170 | A | * | 9/1961 | Clouthier | 439/345 |
| 3,086,191 | A | * | 4/1963 | Olashaw | 439/744 |
| 3,733,576 | A | * | 5/1973 | Cooper | 439/488 |
| 4,017,141 | A | * | 4/1977 | Bury et al. | 439/596 |
| 4,110,696 | A | * | 8/1978 | Meeks | 439/345 |
| 4,302,624 | A | | 11/1981 | Newman | 174/67 |
| 4,545,632 | A | * | 10/1985 | Maier et al. | 439/359 |
| 4,586,765 | A | | 5/1986 | Ban | 339/44 R |
| 4,970,349 | A | | 11/1990 | Jones | 174/67 |
| 5,174,773 | A | | 12/1992 | Jones | 439/147 |
| 5,228,250 | A | * | 7/1993 | Kesselman | 411/5 |
| D354,736 | S | | 1/1995 | Hallett et al. | D13/156 |
| 5,389,013 | A | * | 2/1995 | Kourimsky | 439/744 |
| 5,637,002 | A | * | 6/1997 | Buck et al. | 439/148 |
| 5,702,215 | A | * | 12/1997 | Li | 411/21 |
| 5,725,341 | A | * | 3/1998 | Hofmeister | 411/23 |
| 6,171,129 | B1 | * | 1/2001 | Phillips | 439/346 |
| 6,290,533 | B1 | * | 9/2001 | Major | 439/488 |

OTHER PUBLICATIONS

Ourhouse.com. "Mag Security Clear Outlet Plugs 12PK." http://www.ourhouse.com/cgi–bin/prod_detail.jsp BV_Session ID=@@@@0797799908.0972429228@@@@&BV_EngineID=halje fekjdebedbjfcfcin.0&level=detail&pg_name=prod_results&root_prod_id=1469004–0002&target_page=detail&qty=1&oid=10086.

Ourhouse.com. "MAG Security Clear Outlet Plugs 12PK." http://www.ourhouse.com/cgi–bin/large_prod_detail.jsp?BV_SessionID= @@@@0797799908.0972429228@@@@&BV_EngineID=haljefekjdebedbjfcfcin.0&oid=10086&prod_id= 1469004–0002&level=detail&pg_name–prod_results&rootprod_id=1469004–0002&variations=&prod_name=MAG+Security+Clear+Outlet+Plugs+12PK&out_of_stock=&pagereturn= Oct. 24, 2000.

* cited by examiner

*Primary Examiner*—Renee Luebke
*Assistant Examiner*—Felix D. Figueroa
(74) *Attorney, Agent, or Firm*—Donald J. Coulman

(57) ABSTRACT

A plug includes a disabling mechanism that, upon activation, resists removal of the shaft when inserted into a socket. The plug can also include an indicator that provides an indication that the disabling mechanism has been activated. The plug, which once inserted, changes the state of an electronic device in a substantially permanent manner.

19 Claims, 13 Drawing Sheets

-Prior Art-

-Prior Art-

TAMPER RESISTANT PLUG FOR CHANGING A FUNCTION OF AN ELECTRONIC DEVICE

BACKGROUND OF THE INVENTION

This invention relates generally to plugs that change a function of an electronic device. More particularly this invention relates to a mechanical plug, which once inserted, changes the state of the electronic device such as a computer, personal digital assistant (PDA), or computer modem in a manner that is difficult to change. Typical uses envisioned include disabling of microphone or headphone inputs on computers or telephone line connections on computer modems.

Portable computers, such as laptops, notebooks, hand held and palm top computers, have become quite popular and are rapidly replacing the more traditional desktop computers as users become ever more mobile. In most cases, these portable electronic devices contain one or more input or output connectors to connect to microphones, headphones, or computer modems to name a few. A current trend in electronic devices is to bundle more and more functions together such as video telephony, audio email, internet phone service, voice dictation/voice recognition software. One example is the ability to use a personal computer as a voice answering machine resulting in both digital and audio information being resident in the same device. Increasingly, the distinction between a PDA, cell phone and mobile computer is also rapidly blurring. All of this leads to an issue around security for both business and government offices where sensitive information is available and becomes increasingly susceptible to compromise and theft. Sensitive data can either be in the device or where the device is physically located or in computers to which the device is attached, either via a mobile connection or Local Area Network (LAN) connection.

There is a need to be able in some situations to severely restrict access in a permanent fashion such as preventing the use of a headphone to listen to sensitive audio information; or a microphone to prevent recording of sensitive information; or telephone connections to either send or receive sensitive voice or digital information. In addition, one would like to be able to do this with standard equipment. It is possible to utilize software to disable various devices incorporated into these electronic devices, especially laptop computers. However, one major drawback of relying on software is the ability for someone to either modify the software or find a way to either bypass or workaround the software disablement with no one being aware of the change, and thus, be able to gain access to the sensitive information. The ability to disable a device with hardware in a semi-permanent manner and to be capable of providing a visual or audio indication of the status is both advantageous and desirable. This is especially true where the indicator is easily identifiable by anyone with little or no training. The present invention addresses this issue and provides a simple low cost solution.

SUMMARY OF THE INVENTION

A plug, which is for insertion into a socket connector having an electrical function for an electronic device, includes a shaft that has a cross sectional area smaller than the socket, and a non-electrical disabling mechanism attached to the shaft that resists removal of the plug when inserted into the socket.

DETAILED DESCRIPTION OF THE PREFERRED EMBODIMENT

Figure 1A:
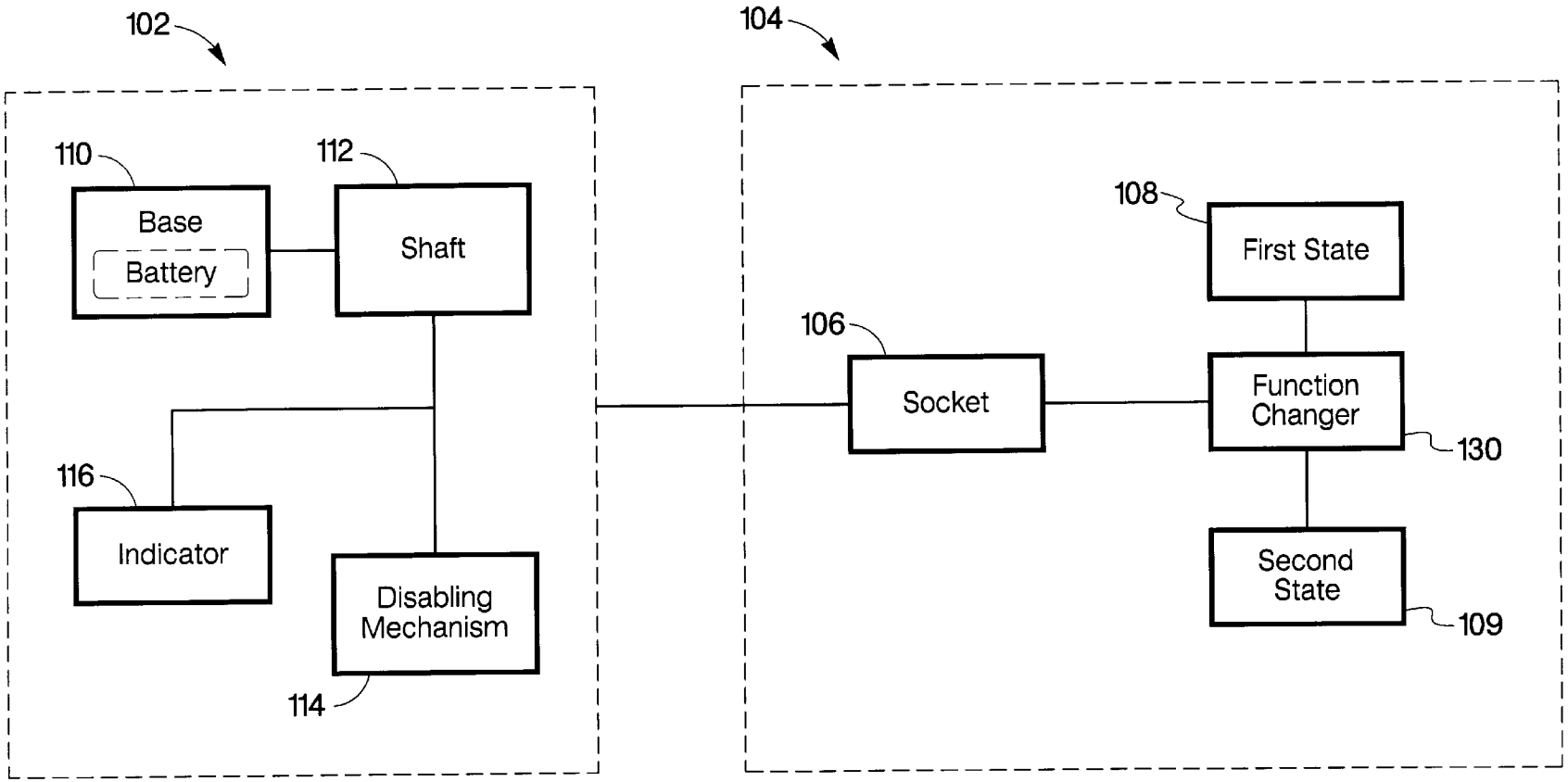
FIG. 1*a* is a block diagram of a disabling plug coupled to a socket according to an embodiment of this invention.
Figure 1B:
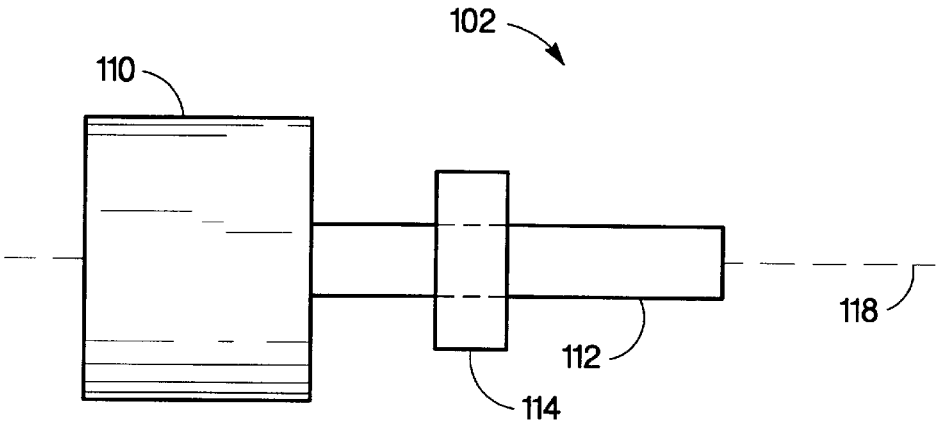
FIG. 1*b* is a side view of a simplified diagram of a disabling plug according to an embodiment of this invention.
Figure 1C:
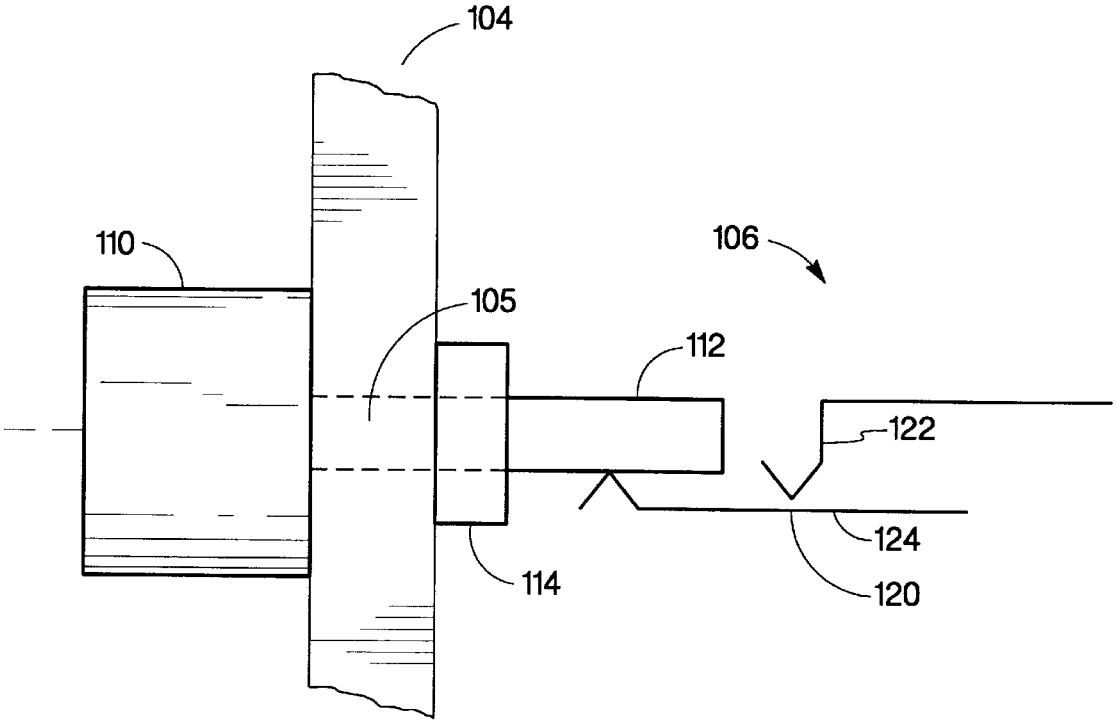
FIG. 1*c* is a side view of a simplified diagram of a disabling plug in a socket according to an embodiment of this invention.

Referring to FIG. 1*a*, disabling plug 102 is used to change a function of electronic device 104 to a substantially permanent state. Disabling plug 102 includes shaft 112, base 110 attached to shaft 112 at one end, disabling mechanism 114 also attached to shaft 112 and indicator 116 as shown FIG. 1*a*, a functional block diagram. When shaft 112 is inserted into socket 106 contained within electronic device 104, function changer 130 changes a function of electronic device 104 from state 108 to state 109. In addition, when shaft 112 is inserted into socket 106 and disabling mechanism 114 is activated then removal of shaft 112 is substantially hindered. A simplified diagram of disabling plug 102 and socket 106 in electronic device 104 is shown in the side view of FIGS. 1*b* and 1*c*. When disabling plug 102, shown in FIG. 1*b*, is inserted along shaft axis 118 into socket 106, as schematically illustrated in FIG. 1*c*, contact 120 is broken, the voltage or signal present on conductor 122 is no longer present on conductor 124. Shaft 112 is the function changer activator causing function changer 130 to change a function of electronic device 104 from state 108 to state 109. The disabling plug-and-socket connector shown in FIGS. 1*b* and 1*c* is typically referred to as a jack. This type of connector is typically used when rapid and easy connections between electronic devices is desired. The insertion of disabling plug 102 causes one or more switching functions to occur, such as the breaking of a circuit or the routing of a signal to another device. Disabling plug 102 slides into socket 106 as shown schematically in FIG. 1*c*. The contacts typically are arranged linearly along the length of the shaft and socket and are insulated from each other. Two or more contacts may be used. There are situations, however, when a rapid and easy connection is not desired by the user, such as corporate or government laboratories where sensitive information is either stored within or linked to electronic device 104.

Figure 2A:
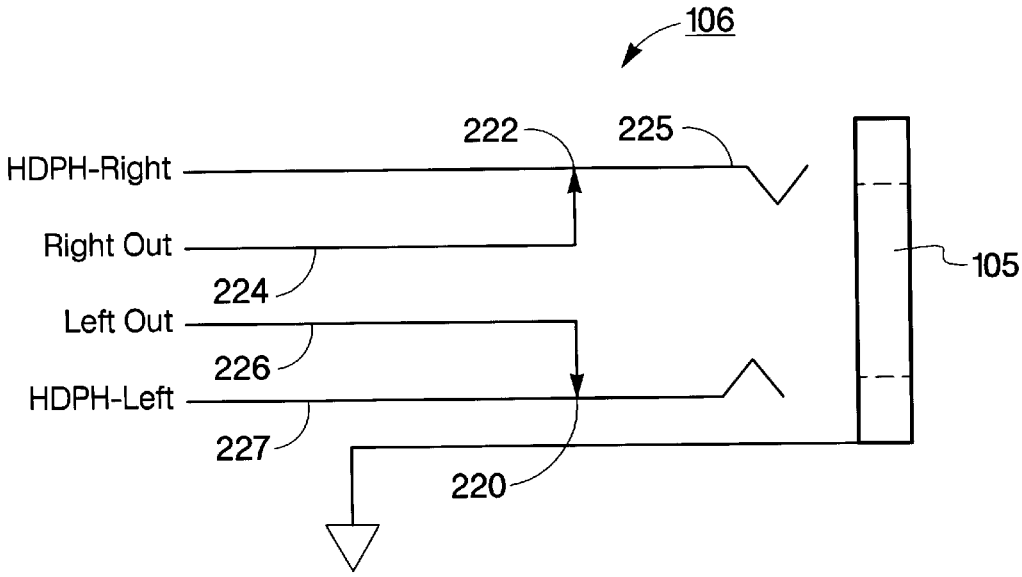
FIG. 2*a* is a schematic diagram of a socket according to an embodiment of this invention.

FIG. 2*a* is a schematic diagram of socket 106 in one embodiment of this invention. In this embodiment socket 106 provides the connection to a typical headphone set plug. Typically, the user inserts a headphone set plug into socket 106 breaking contacts 220 and 222 routing the left ear signal through conductor 227 to the headphone, and the right ear signal through conductor 225 to the headphone. When the headset is not plugged into socket 106 the left and right headphone signals are routed through contacts 220 and 222 respectively to conductors 226 and 224 to the internal left and right speakers. If the user desires to prevent this function from being utilized the user inserts disabling plug 102 into socket 106 in the current embodiment, breaking contacts 220 and 222, and engaging disabling mechanism 114, wherein the removal of disabling plug 102 through socket opening 105 from socket 106 is substantially hindered. Disabling plug 102 does not have the ability to be operationally connected to a headphone, thus both the headphone function and speaker function are prevented from operating. In addition only with considerable effort and possible damage to either electronic device 104 or disabling plug 102 or both can disabling plug 102 of the present invention be removed from socket 106, thus changing the state of the headphone function in a substantially permanent manner. An example of when the use of a headphone jack is not desirable is when very sensitive audio information is stored in electronic device 104.

Figure 2B:
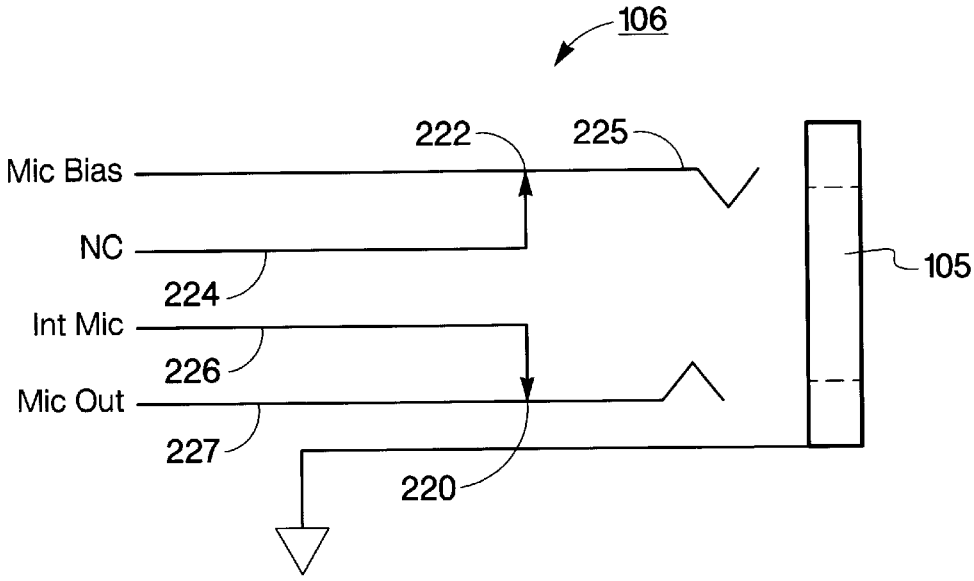
FIG. 2*b* is a schematic diagram of a socket according to an embodiment of this invention.

FIG. 2*b* is a schematic diagram of socket 106 in another embodiment of this invention. In this embodiment socket 106 provides the connection to a typical external microphone. Typically, the user would insert a microphone plug into socket 106 establishing a connection through conductor 225 with the microphone bias voltage, and breaking contact 220 disabling the internal microphone and the microphone output signal is routed through conductor 227. In this embodiment, if the user desires to prevent the use of both the internal microphone and an external microphone the user inserts disabling plug 102 into socket 106 in the current embodiment breaking contact 220 and engaging disabling mechanism 114 substantially hindering the removal of disabling plug 102 from socket 106. In this embodiment, disabling plug 102 prevents both the operation of an external microphone as well as the internal microphone. As described above only with considerable effort and possible damage to either electronic device 104 or disabling plug 102 or both can disabling plug 102 be removed from socket 106, thus changing the state of the microphone function in a substantially permanent manner. An example of when the use of a microphone jack is not desirable is when recording of conversations or activity in the area around electronic device 104 without others' knowledge, could lead to the compromise of sensitive information. In addition, disabling plug 102 also limits the ability to remotely activate either an internal or external microphone to acquire sensitive information if electronic device 104 is connected to the web a Local Area Network (LAN) or any other means such as a wireless modem where remote activation is possible.

Figure 3A:
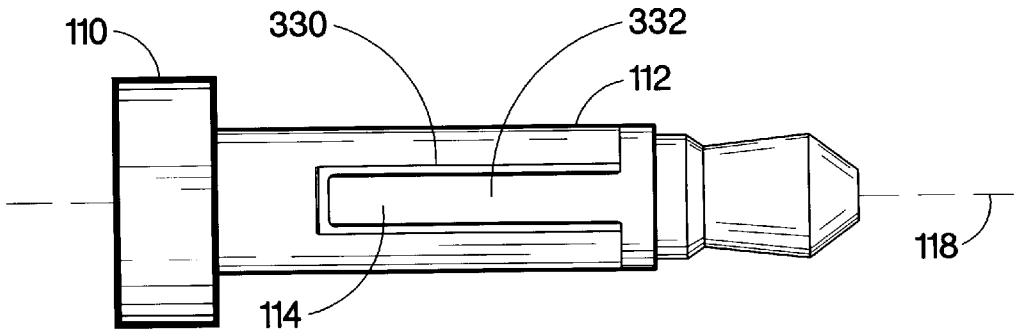
FIG. 3*a* is a top view of a disabling plug according to an embodiment of this invention.
Figure 3B:
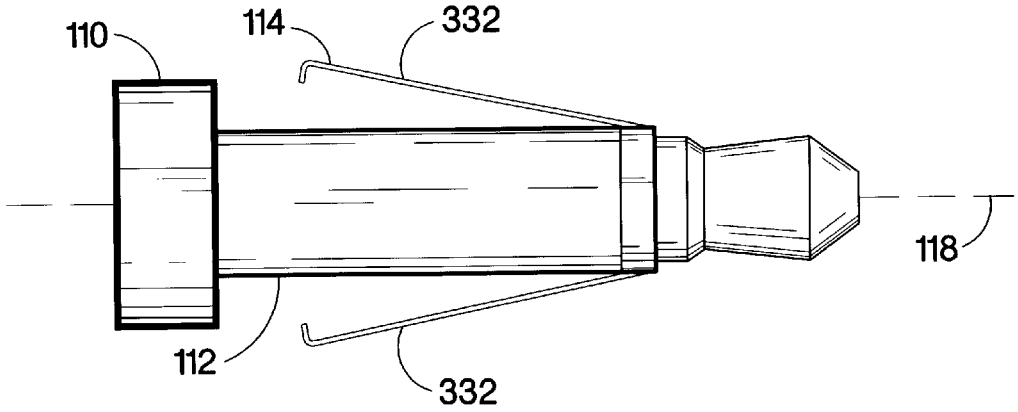
FIG. 3*b* is a side view of a disabling plug according to an embodiment of this invention.

FIGS. 3*a*–3*b* shows a top view and side view respectively of disabling plug 102 in one embodiment of this invention, where disabling plug 102 includes shaft 112 and disabling mechanism 114. In this embodiment, when shaft 112 is inserted into socket 106, shaft 112 is the function changer activator causing function changer 130 to change a function of electronic device 104 from state 108 to state 109. In this embodiment, disabling mechanism 114 contains a moveably projecting portion that consists of two arms 332 which are extendable and biased in a direction perpendicular to shaft axis 118. When disabling plug 102 in this embodiment is inserted into socket 106 through socket opening 105, arms 332 are compressed into recessed structure 330. Once disabling plug 102 is fully inserted into socket 106 the bias of arms 332 forces arms 332 to extend back to substantially the original extension before insertion. In this embodiment, after disabling plug 102 is fully inserted into socket 106, attempts to remove disabling plug 102 from socket 106 typically will either damage disabling plug 102 or socket 106 or both. Those of ordinary skill in the art will appreciate that any number of arms can be utilized in this embodiment.

Figure 4A:
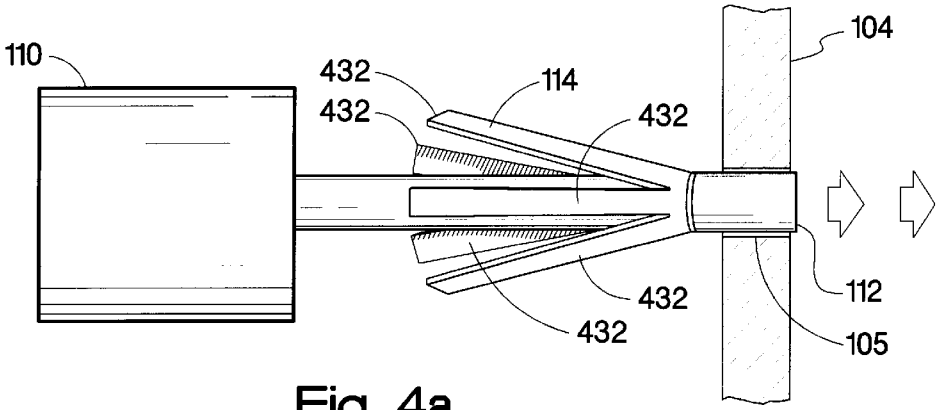
FIG. 4*a* is a side view of a disabling plug according to an embodiment of this invention.
Figure 4B:
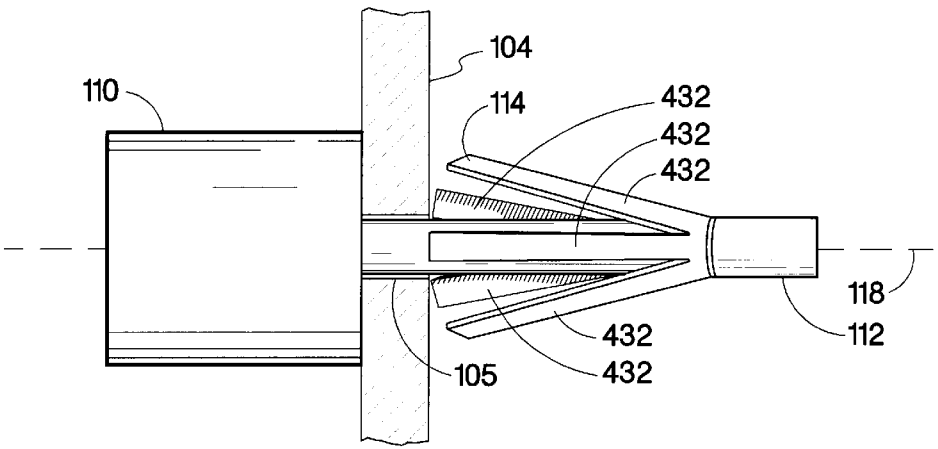
FIG. 4*b* is a side view of a disabling plug after insertion according to an embodiment of this invention.

FIG. 4*a* shows another embodiment of this invention, where disabling mechanism 114 includes five arms 432 that are all extendable and biased in a direction perpendicular to shaft axis 118. In this embodiment, shaft 112 is the function changer activator. Although FIGS. 3*a*–3*b* and FIG. 4*a* show two or five arms respectively, those of ordinary skill in the art readily recognize that any number of arms can be utilized.

Figure 5A:
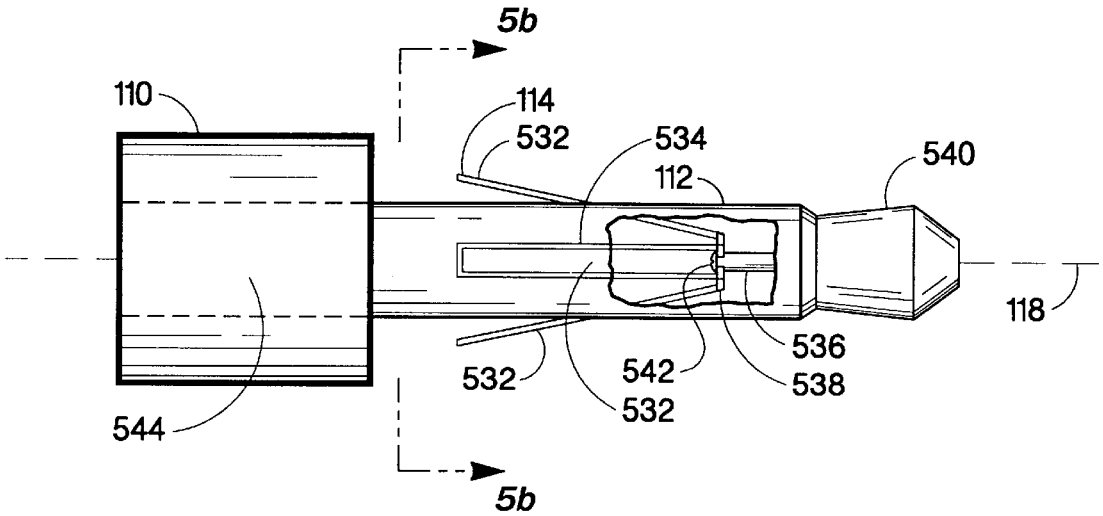
FIG. 5*a* is a side view of a disabling plug according to an embodiment of this invention.
Figure 5B:
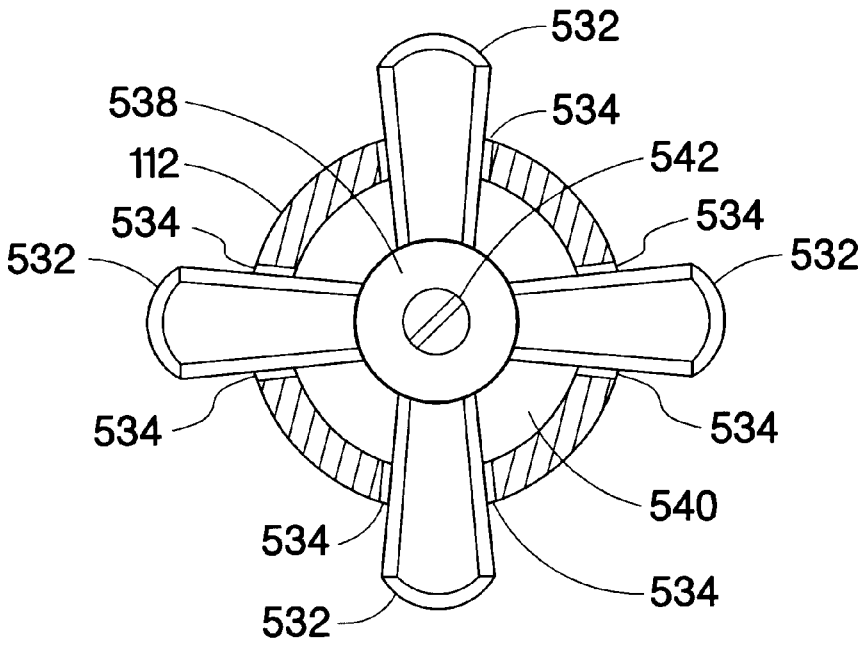
FIG. 5*b* is a cross-section view along 5*b* —5*b* showing the disabling mechanism shown in FIG. 5*a* after activation.
Figure 5C:
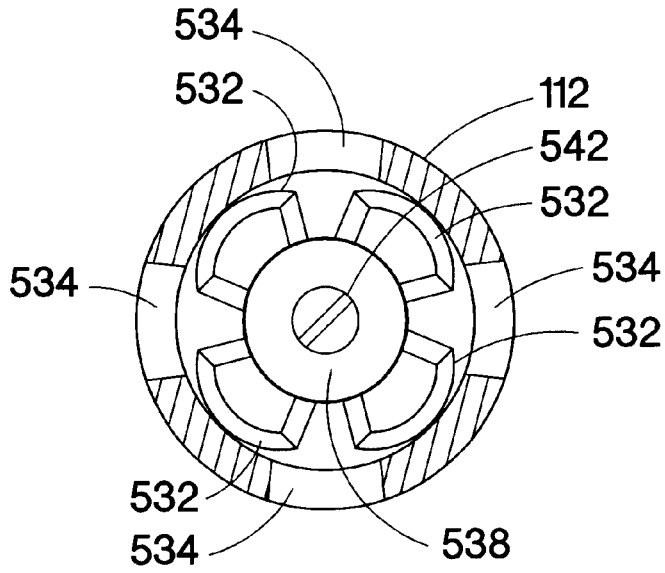
FIG. 5*c* is a cross-sectional view along 5*b* —5*b* showing the disabling mechanism shown in FIG. 5*a* before activation.

FIG. 5*a* shows in a plan view of another embodiment of this invention, where disabling mechanism 114 includes four arms 532 that are extendable and biased in a direction perpendicular to shaft axis 118 and arms 532 extend in a radial direction through openings 534 in shaft 112. In this embodiment shaft 112 is a hollow shaft with rod 536 mounted to free end 540 of shaft 112. Disabling mechanism 114 is maintained in a desired position relative to shaft 112 by rod 536 which is rotatably attached to base portion 538 of disabling mechanism 114. Screw head 542 is attached to base portion 538. Rotating screw head 542 rotates arms 532 relative to shaft 112. Base 110 has opening 544 which allows access to screw head 542. FIGS. 5*b*–5*c* are cross-sectional views of disabling plug 102 perpendicular to shaft axis 118. FIG. 5*b* shows arms 532 extended in a radial direction through openings 534 in shaft 112. Prior to insertion of disabling plug 102 into socket 106 arms 532 are rotated away from openings 534 and are held within shaft 112. Once disabling plug 102 is inserted into socket 106 and the activation of disabling mechanism 114 is desired, screw head 542 is rotated approximately forty five degrees to align arms 532 with openings 534 where arms 532 will extend radially from shaft 112. Although in FIGS. 5*b* and 5*c* screw head 542 is shown as a standard slotted screw head those of ordinary skill in the art will readily recognize that any number of structures for screw head 542 can be utilized. Examples are Phillips, hex, square, or torx to name a few.

Figure 6A:
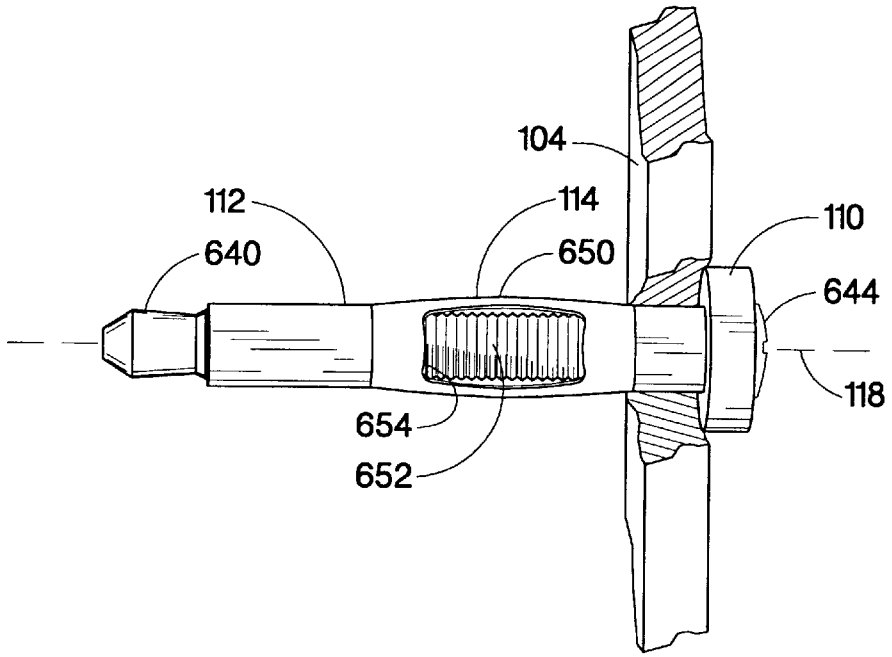
FIG. 6*a* is a side view of a disabling plug according to an embodiment of this invention.
Figure 6B:
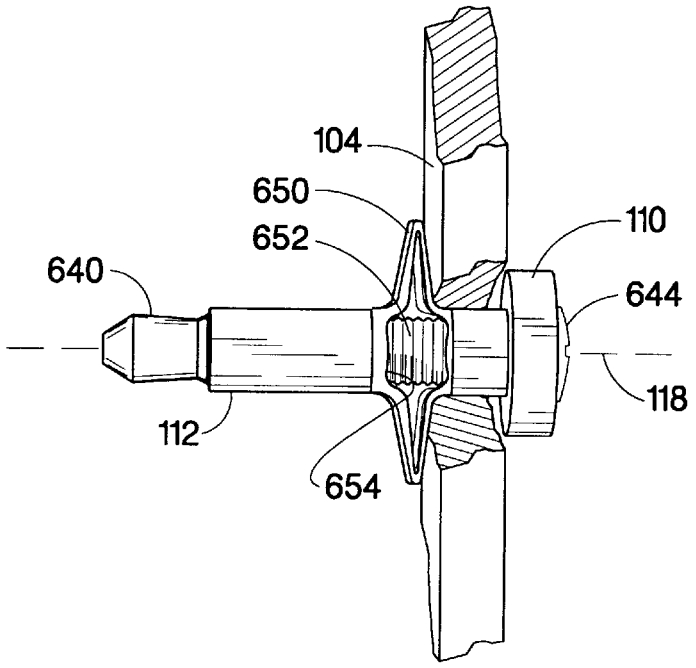
FIG. 6*b* is a side view of a disabling plug where the disabling mechanism shown in FIG. 6*a* is fully activated.

FIGS. 6*a*–6*b* show plan views of disabling plug 102 in another embodiment of this invention, where disabling plug 102 includes shaft 112 and disabling mechanism 114. In this embodiment, disabling mechanism 114 includes two deformable ribs 650 which are capable of being deformed in a direction perpendicular to shaft axis 118 when screw head 644 is rotated. In this embodiment shaft 112 is preferably a hollow shaft with screw 652 threadably engaged with threaded portion 654 attached to shaft 112 at the free end portion of deformable ribs 650. Disabling plug 102 in this embodiment is inserted into socket 106 through socket opening 105. Once disabling plug 102 is fully inserted into socket 106 and the activation of disabling mechanism 114 is desired, screw head 644 is rotated turning screw 652 until deformable ribs 650 are snug against the back side of socket 106. This operation is analogous to the insertion and installation of a Molly fastener used as a wall anchor. As will be readily appreciated by those of ordinary skill in the art, as screw 652 is rotated, free end 640 is drawn closer to the back side of socket 106 until deformable ribs 650 of disabling plug 102 contact the back side of socket 106 hindering further rotation of screw 652. In this embodiment, when further rotation of screw 652 is hindered, attempts to remove disabling plug 102 from socket 106 will typically either damage disabling plug 102 or socket 106 or both. Further, in this embodiment those skilled in the art will readily recognize that any number of tamper resistant screw head designs are all equally preferable, such as a one way screw head.

Figure 7A:
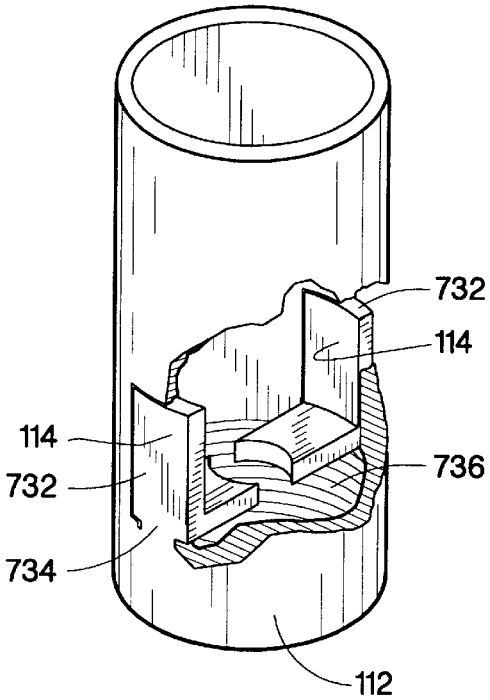
FIG. 7*a* is an isometric view of the shaft of a disabling plug according to an embodiment of this invention.

FIG. 7*a* shows a perspective view of shaft 112 in another embodiment of this invention which acts as function changer 130. Two examples are as a microphone plug shaft 112 as shown in FIG. 2*b* or as a modem plug inhibiting electrical connection. In this embodiment, disabling mechanism 114 includes two L-shaped arms 732 attached to shaft 112 by hinge portions 734. Preferably, hinge portion 734 is flexible, however those skilled in the art readily recognize that a mechanical hinge can also be utilized. L-shaped arms 732 are capable of being extended in a direction perpendicular to shaft axis 118 when screw head 746 is rotated. In this embodiment shaft 112 is preferably a hollow shaft with screw 746 threadably engaged with threaded portion 736 of shaft 112 at the end attached to base 110.

Figure 7B:
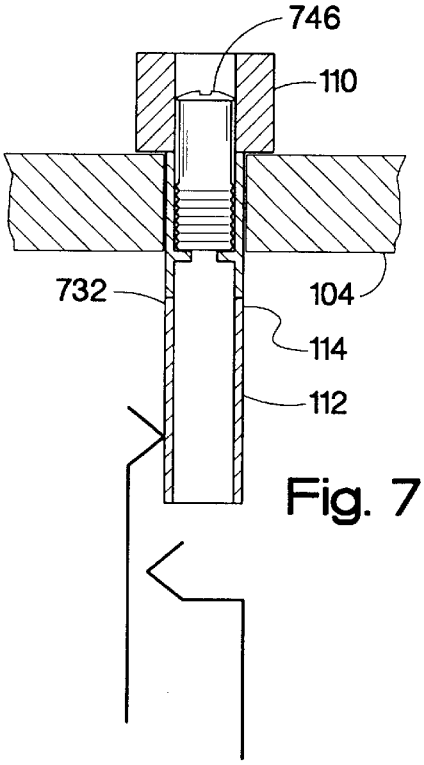
FIG. 7*b* is a cross-sectional view of the disabling plug shown in FIG. 7*a* showing the disabling mechanism before activation.
Figure 7C:
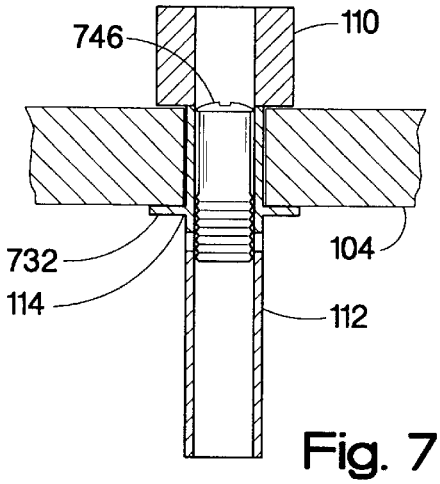
FIG. 7*c* is a cross-sectional view of the disabling plug shown in FIG. 7*a* showing the disabling mechanism after activation.

Disabling plug 102 is inserted into socket 106 through socket opening 105 as shown in FIG. 7*b*. Once disabling plug 102 is fully inserted into socket 106 and the activation of disabling mechanism 114 is desired screw 746 is rotated engaging L-shaped arms 732. Screw 746 is rotated further as L-shaped arms 732 pivot outward perpendicular to shaft axis 118. Rotation of screw 746 is continued until L-shaped arms 732 are snug against the backside of socket 106 as shown in FIG. 7*c*. In this embodiment, screw 746 preferably has a one way head. Those of ordinary skill in the art will appreciate that other tamper resistant screw heads are equally preferable. In this embodiment, when further rotation of screw 746 is hindered, attempts to remove disabling plug 102 from socket 106 will typically either damage disabling plug 102 or socket 106 or both.

Figure 8A:
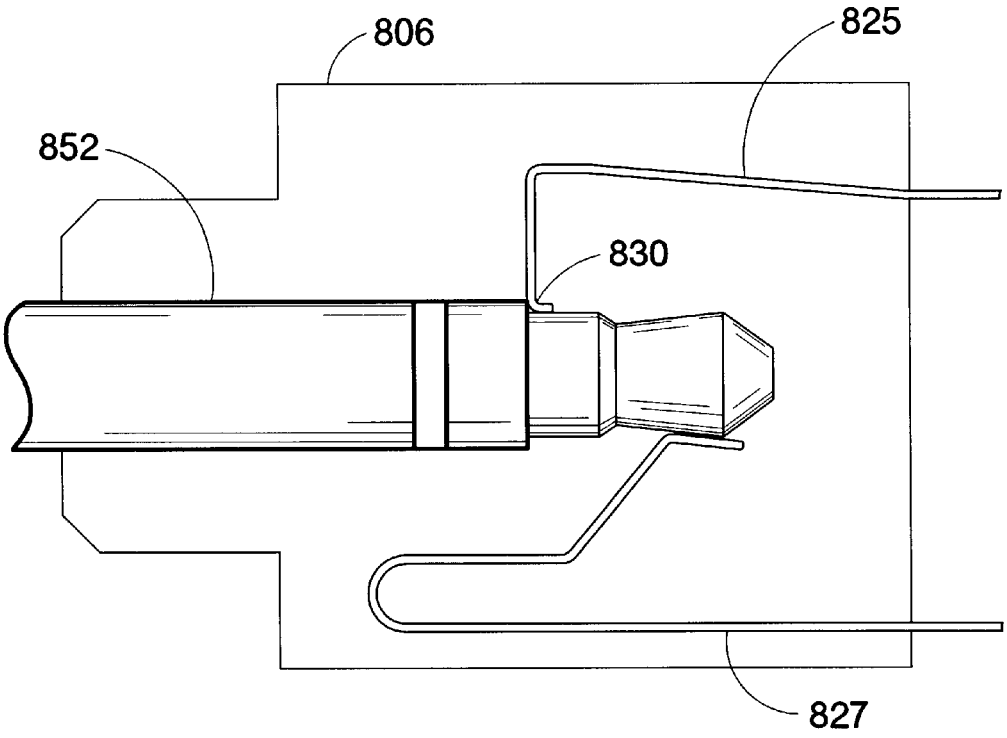
FIG. 8*a* is a cross-sectional view of a socket with the plug inserted according to an embodiment of this invention.

FIG. 8*a* shows a plan view of normal plug 852 inserted into socket 806 in another embodiment of this invention. In this embodiment conductor 825 acts as a spring arm and has engagable portion 830 which makes electrical contact with normal plug 852. In this embodiment when normal plug 852 is inserted into socket 806, electronic device 104 operates in a standard mode, where standard mode is defined as the function the conductor would normally provide before being disabled. Conductor 827 also operates in a standard mode. However, those skilled in the art will readily appreciate that alternatively either modifying conductor 827 to have engagable portion 830 or modifying both conductor 825 and conductor 827 to have engagable portion 830 can both be utilized as well.

Figure 8B:
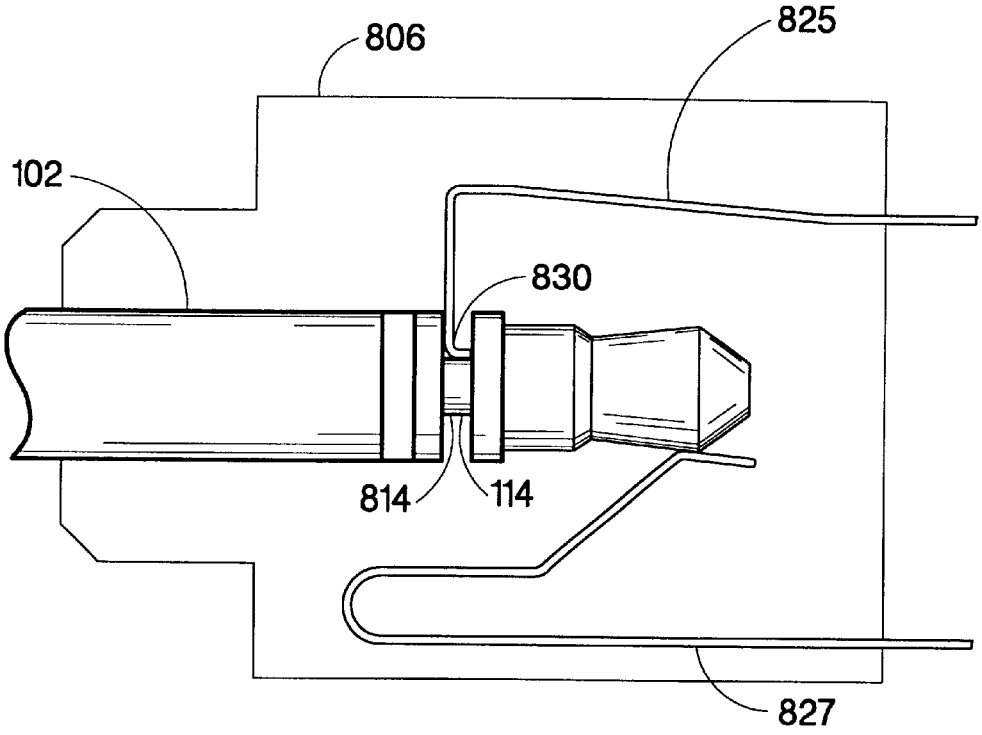
FIG. 8*b* is a cross-sectional view of a socket with the disabling plug inserted according to an embodiment of this invention.

FIG. 8*b* shows a plan view of disabling plug 102 inserted into socket 806 in another embodiment of this invention. In this embodiment, disabling mechanism 114 consists of groove 814, which slidably engages engagable portion 830 of conductor 825. Once disabling plug 102 is fully inserted into socket 806 attempts to remove disabling plug 102 from socket 806 will typically either damage disabling plug 102 or socket 806 or both.

Figure 9A:
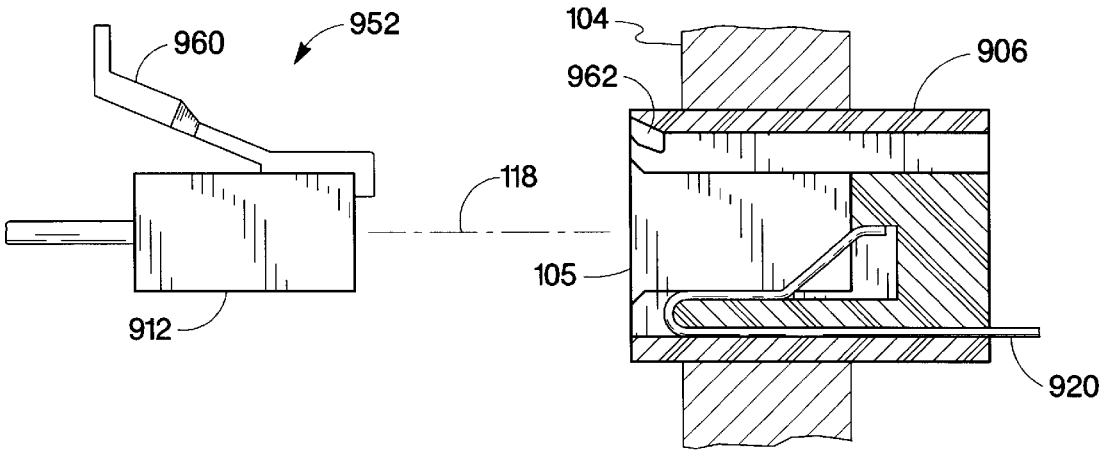
FIG. 9*a* is a cross-sectional view of a socket with the plug before insertion according to an embodiment of this invention.

FIG. 9*a* shows a plan view of normal plug 952 and socket 906 in another embodiment of this invention. In this embodiment plug 952 is representative of a telephone line connector commonly referred to as RJ-11 or RJ-45 and socket 906 is the corresponding socket for these connectors respectively. When plug 952 is inserted into socket 906 through socket opening 105 release arm 960 engages stop 962 holding plug 952 in socket 906. The conductors (not shown) in shaft 912 make electrical contact with conductors 920 in socket 906. When release lever 960 is pressed toward shaft 912 release arm 960 disengages stop 962 allowing plug 952 to be removed from socket 906.

Figure 9B:
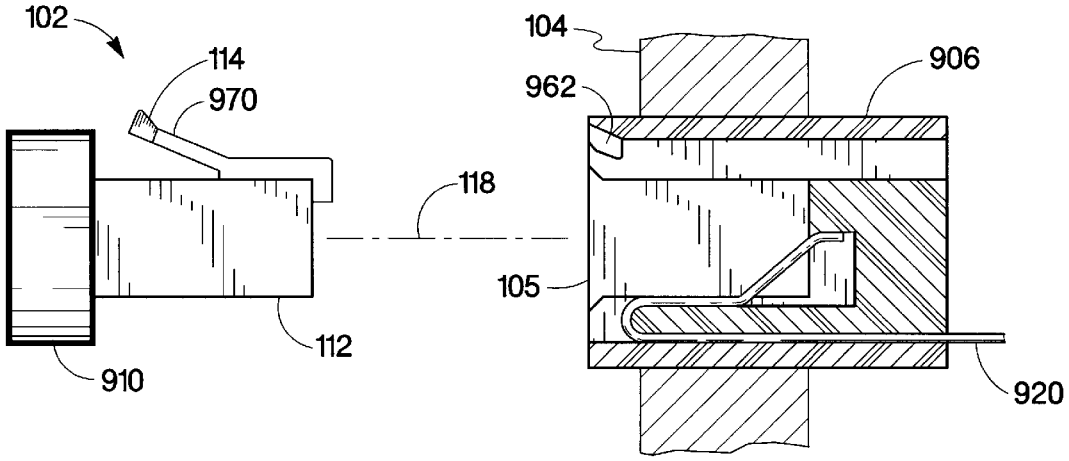
FIG. 9*b* is a cross-sectional view of a socket with the disabling plug before insertion according to an embodiment of this invention.

FIG. 9*b* shows a plan view of disabling plug 102 inserted into socket 906 in another embodiment of this invention. In this embodiment, disabling plug 102 is similar to a telephone line connector commonly referred to as RJ-11 or RJ-45 and socket 906 is the corresponding socket for these connectors respectively. Both base 910 and shaft 112 have a rectangular cross-section in this embodiment. Those skilled in the art will readily recognize that this embodiment will work with any connector utilizing a similar latching mechanism as that of the RJ-11 or RJ0-45 plugs. When disabling plug 102 is inserted through socket opening 105 into socket 906 locking arm 970 engages stop 962. In this embodiment, disabling mechanism 114 consists of locking arm 970 that is held in place by stop 962. Once disabling plug 102 is fully inserted into socket 906 attempts to remove disabling plug 102 from socket 906 will typically either damage disabling plug 102 or socket 906 or both. Those of ordinary skill in the art will appreciate that a similar disabling mechanism as locking arm 970 can be utilized on connectors commonly referred to as Universal Serial Bus (USB) connectors.

Figure 10:
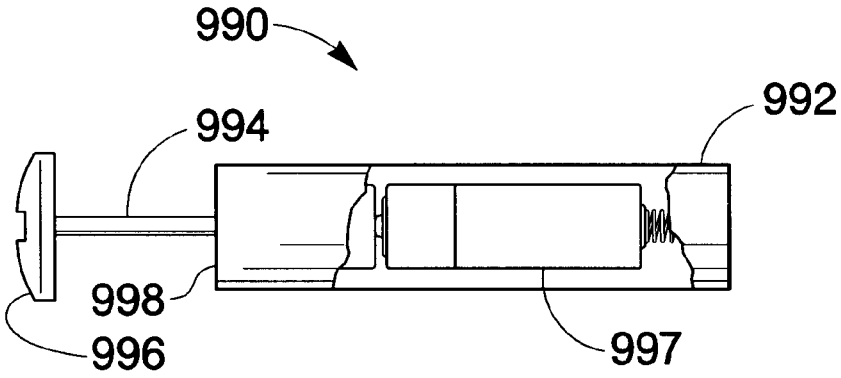
FIG. 10 is a side view of a screw according to an embodiment of this invention.

FIG. 10 shows a plan view of break off mechanism 990 for those embodiments which activate disabling mechanism 114 by rotation, examples of which are shown in FIGS. 5*a*, 6*a*–6*c* and 7*a*–7*c*. As shown in FIG. 10 break off mechanism consists of body 992 with screw head 996 attached at one end via break off portion 994. Body 992 may be threaded when used in those embodiments requiring multiple turns to engage disabling mechanism 114 such as the embodiment shown in FIG. 6. For those embodiments that require less than a full turn to activate disabling mechanism 114, body 992 need not be threaded, as shown in FIG. 5. Break off portion 994 is substantially smaller in cross section than body 992. When disabling mechanism 114 is activated by rotation of screw head 996 preferably 2–10 pound inches of torque is used to rotate screw head 996 and break off portion 994 is broken off at a torque about twice that used for activation. Those of ordinary skill in the art will readily appreciate that any torque less than the torque necessary to cause damage to either disabling plug 102 or socket 906 can be used. When break off portion 994 is broken off then indicator surface 998 is visible. Indicator surface 998 is a surface is readily visible to an average person. Preferably, indicator surface 998 is brightly colored such as read, yellow or green. Those of ordinary skill in the art appreciate there are many colors that are equally preferable. Those of ordinary skill in the art readily recognize that any number of break off portions 994, such as two or three members can also be utilized. Those of ordinary skill in the art will also readily recognize there are many other types of break off mechanisms that can be utilized.

An alternate embodiment of indicator surface 998 that can be used in all of the embodiments shown is the use of a light source such as a light emitting diode (LED) to indicate that disabling mechanism 114 has been activated. For those embodiments, such as a microphone jack as one example, which have available a bias voltage the LED can be powered directly from that bias voltage when sufficient power is available. For those embodiments, such as a headphone jack or telephone line connection as two examples which typically do not have a bias voltage available the LED can be powered through a battery located in base 110. An alternate embodiment of indicator surface 998 uses an audio source to produce an audible sound. When sufficient power is available from socket 106 the audio generating source preferably is powered from that power source, however, the audio source can also be powered from a battery as well. As those of ordinary skill in the art will appreciate when an audible sound is used to indicate disablement it is preferable to have a sensor circuit incorporated in the disabling plug 102 to emit an audible sound when the disabling mechanism has been activated but is not functioning properly.

What is claimed is:

1. An electrical interconnection system, comprising:

an electronic device having a socket connector with an opening area; and a plug, adapted to change a function of the electronic device when inserted into the socket connector, the plug having:

a shaft adapted to fit within the socket opening; and a disabling mechanism attached to the shaft, the disabling mechanism including a moveably projecting portion with at least one arm, the arm being operable between a compressed position facilitating insertion of the shaft through the socket opening and an extended position preventing removal of the plug wherein inserting the plug into the socket precludes removal of the shaft without damaging either the plug or socket connector, and changes a function of the electronic device.

2. A method for changing a function of an electronic device utilizing a connector in a socket with a plug that includes a disabling mechanism, comprising the steps of:

accepting insertion of the plug into the socket of the electronic device;

changing the function of the electronic device in response to the insertion; and activating the disabling mechanism, whereby the plug cannot be removed from the electronic device without damage to the electronic device.

3. The method of claim 2, further comprising the step of rotation to activate the disabling mechanism.

4. The method of claim 2, further comprising the step of installing a battery in the plug.

5. A method for changing a function of an electrical socket in a substantially permanent manner with a mating plug, comprising:

accepting insertion of the mating plug into the electrical socket without mechanically or electrically damaging the electrical socket;

changing the function of the electrical socket in response to said insertion; and activating a mechanical disabling mechanism attached to the plug whereby the plug cannot be removed from the electrical socket without damage to the electrical socket or to the mating plug.

6. The method in accordance with claim 5, wherein accepting insertion of the mating plug further comprises electrically coupling a plug conductor to an electrical conductor of the electrical socket.

7. The method in accordance with claim 5, wherein activating the mechanical disabling mechanism further comprises activating an indicator.

8. The method in accordance with claim 7, wherein activating the indicator further comprises activating a light source externally visible from the mating plug.

9. The method in accordance with claim 7, wherein activating the indicator further comprises activating an audio source.

10. The method in accordance with claim 5, wherein the electrical socket is electrically coupled to an electronic device.

11. The method in accordance with claim 10, wherein changing the function of the electrical socket further comprises changing an internal function of the electronic device in a substantially permanent manner.

12. The method in accordance with claim 10, wherein changing the function of the electrical socket further comprises changing an external function of the electronic device in a substantially permanent manner.

13. The method in accordance with claim 10, wherein changing the function of the electrical socket further comprises disabling a local area network function of the electronic device in a substantially permanent manner.

14. The method in accordance with claim 10, wherein changing the function of the electrical socket further comprises disabling a telephone line function of the electronic device in a substantially permanent manner.

15. The method in accordance with claim 6, wherein changing the function of the electrical socket further comprises engaging a contact breaker with an electrical conductor of the electrical socket thereby changing a state of the electronic device.

16. The method in accordance with claim 15, wherein engaging the contact breaker further comprises disabling an external headphone speaker function of the electronic device in a substantially permanent manner.

17. The method in accordance with claim 15, wherein engaging the contact breaker further comprises disabling an internal speaker in the electronic device in a substantially permanent manner.

18. The method in accordance with claim 15, wherein engaging the contact breaker further comprises disabling an internal microphone in the electronic device in a substantially permanent manner.

19. The method in accordance with claim 15, wherein engaging the contact breaker further comprises disabling an external microphone function of the electronic device in a substantially permanent manner.

* * * * *

UNITED STATES PATENT AND TRADEMARK OFFICE

CERTIFICATE OF CORRECTION

PATENT NO. : 6,595,792 B1
DATED : July 22, 2003
INVENTOR(S) : Brandon E. Wise et al.

It is certified that error appears in the above-identified patent and that said Letters Patent is hereby corrected as shown below:

Column 9,
Line 51, delete “adhesives” and insert -- adhesive --.

Signed and Sealed this

Fifteenth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,595,792 B1
DATED : July 22, 2003
INVENTOR(S) : Daniel C. Rudolph et al.

It is certified that error appears in the above-identified patent and that said Letters Patent is hereby corrected as shown below:

This certificate supersedes Certificate of Correction issued June 15, 2004, the number was erroneously mentioned and should be vacated since no Certificate of Correction was granted.

Signed and Sealed this

Twentieth Day of July, 2004

JON W. DUDAS
*Acting Director of the United States Patent and Trademark Office*